United States Patent [19]

Brook et al.

[11] 3,989,551

[45] Nov. 2, 1976

[54] METHOD OF MAKING A HEAT-RECOVERABLE ARTICLE

[75] Inventors: Greville B. Brook, Beaconsfield; Roger F. Iles, Ickenham, both of England

[73] Assignee: Fulmer Research Institute Limited, Stoke Poges, England

[22] Filed: Feb. 12, 1975

[21] Appl. No.: 549,328

Related U.S. Application Data

[63] Continuation-in-part of Ser. No. 88,970, Nov. 12, 1970, abandoned.

[30] Foreign Application Priority Data

Nov. 12, 1969 United Kingdom ..... 55481/69
Nov. 14, 1969 United Kingdom ..... 55969/69

[52] U.S. Cl. ..... 148/11.5 R
[51] Int. Cl.[2] ..... C22D 1/00
[58] Field of Search ..... 148/11.5 R

[56] References Cited

UNITED STATES PATENTS 3,558,369 1/1971 Wang et al. ..... 148/11.5 R
3,567,523 3/1971 Jackson et al. ..... 148/11.5 R
3,594,239 7/1971 Wang ..... 148/13

*Primary Examiner*—W. Stallard
*Attorney, Agent, or Firm*—Brady, O'Boyle & Gates

[57] ABSTRACT

A method of making a heat-recoverable article which comprises cooling an article in a first shape from a first temperature to a lower temperature, said article being formed from an alloy comprising at least one phase in the form of a primary solid solution of a first metal with at least one other metallic element, which solution on cooling from said first temperature either (1) at least partially transforms into an essentially bonded martensite or (2) retains the high temperature phase but which transforms to an essentially bonded martensite on cold working, and then deforming the article into a second shape, the temperature and rate of cooling being such that, on reheating, the article at least partly resumes the first shape.

14 Claims, No Drawings

METHOD OF MAKING A HEAT-RECOVERABLE ARTICLE

REFERENCE TO RELATED APPLICATIONS

This application is a continuation-in-part of application Ser. No. 88,970, filed Nov. 12, 1970, now abandoned.

BACKGROUND OF THE INVENTION

It is known that certain metal alloys are heatrecoverable, that is to say, when a suitably heat-treated article of one shape made from such an alloy is caused to deform into another shape at an appropriate temperature and the article is subsequently heated to a sufficiently higher temperature, the article will at least partly recover its original shape. This change of shape on reheating corresponds to a change of phase in the alloy from a low-temperature phase to a high-temperature phase. The phenomenon of heat recoverability is known to occur with articles made from nickel-titanium binary containing 52 - 56 percent by weight of nickel and also with certain gold-cadmium and cadmium-silver-gold alloys.

DESCRIPTION OF THE INVENTION

The known alloys which manifest this property are all intermetallic compounds. We have now discovered that the same property of change of shape at a certain temperature, i.e., heat recoverability, can be obtained with materials which are not intermetallic compounds. More particularly, we have discovered that in primary solid solutions of certain metals it is possible to produce a transformation to a martensitic phase which exhibits the same phenomenon of reversible shape change at a critical temperature.

The term primary solid solution as used in this specification connotes the product obtained when atoms of one or more different elements can be added to a pure metal without producing a change of crystal structure, by replacing atoms in the various sites of the pure metal crystal structure.

The treatment required to produce this phenomenon of heat recoverability is to deform the alloy when it is either in the fully martensitic form or partly in the martensitic form and partly in a metastable, high-temperature, non-martensitic form which transforms into martensite under the influence of the deforming stress or fully in the latter form. On reheating to above a temperature denoted the $A_s$ temperature, the alloy will transform to the higher temperature phase and concurrently revert fully or at least partly to its original shape. Provided the alloy is not heated to too high a temperature, this process of deformation and recovery may be repeated again and again.

It has now been found in accordance with the present invention that a heat-recoverable article is provided by a process which comprises cooling an alloy in a first shape from a first temperature to a lower temperature, said alloy comprising at least one phase in the form of a primary solid solution of a first metal with at least one other element, which solution either transforms into an essentially banded martensite on cooling from said first temperature or alternatively fully or partially retains the high temperature form or mere cooling, but transforms to an essentially banded martensite on cold working, and then plastically deforming the alloy into a second shape, the temperatures and rate of cooling being such that on reheating, the article at least partly resumes said first shape.

Generally in practice, an article formed from such an alloy is quenched to room or other suitable temperature such that the high temperature phase is retained in metastable high temperature form. The article is then deformed into a new shape by cold working. This causes the alloy to transform from its high temperature phase to a stress-induced martensite, though some of the deformation may be accommodated by other processes such as slip or twinning. As above indicated, in some cases cooling alone affords martensite which is then deformed. In either case on reheating the deformed shape so produced, the martensitic phase transforms back to the high temperature form at the appropriate temperature (usually known as the As temperature) and the article reverts to or at least towards its original shape. The extent to which the reversion to the original shape is complete depends on the extent to which the original deformation was accommodated by the formation of martensite. If slip or twinning deformation also takes place during this process this part of the deformation cannot be recovered. The heat recoverable strain can therefore be obtained from martensite formed by stress deformation from the metastable high temperature solid solution or from martensite formed by simple cooling followed by deformation.

If the alloy structure is not totally austentic in the high temperature form, i.e., if it co-exists with a second phase (such as, alpha in titanium alloys or alternatively an intermetallic compound) or if another solid solution or intermetallic compound precipitates during cooling, heat recoverable strain can still be obtained provided that (a) the austenitic phase(s) of such a composition transform into martensite on cooling or when cold worked, and (b) there is not an excessive amount of the second phase (e.g. more than about 40 percent, although the actual amount permissible depends on its distribution), and the second phase does not interfere with the nucleation or growth mechanism of martensite formation.

The heat recovery is obtained when heating the deformed article through the As temperature and up to the Af temperature. The As temperature is the temperature at which martensite starts to transform back to the austenitic phase, while the Af temperature is the temperature at which the martensite has totally transformed to the austenitic phase. The As temperature can be as high as 300° – 400° C for many of the alloys of the instant invention.

DETAILED DESCRIPTION OF THE INVENTION

The solid-solution alloys suitable for the practice of the instant invention include alloys based on titanium, manganese or cobalt. By "based on" is meant that the solid solution has the same crystal structure as does one of the above elements in the unalloyed form. In general, said element will be the major solution component. The solute metal can in general suitably be niobium, molybdenum, iron, nickel, chromium, or vanadium or mixtures thereof. Solutions comprising mixtures of titanium, manganese and/or cobalt with each other or with any of the above solute metals are also suitable. Although, of course, all combinations of any of the above-enumerated base or solute metals may not be suitable, any of the possible combinations are suitable provided that the solid solution so formed transforms on quenching fully or partly into martensite or alternatively retains the austenitic phase on quenching which transforms to martensite on cold-working or still further cooling. Generally, quenching is suitably effected from temperatures in the range of about 800° – 1200° C. What is unsuitable is an alloy that on quenching transforms into a form incapable of transformation into martensite either by further cooling and/or cold-working. The optimum quenching temperature and rate of cooling depends on the precise alloy composition and can be determined by routine experimentation. In some alloys the high temperature phase can be retained by slow cooling to about room temperature. Transformation to martensite is then effected by still further cooling and/or cold working.

The alloys of the instant invention may, of course, contain impurities and/or other incidental elements included to modify the properties of the alloy provided only that a solid solution exhibiting the required martensite transformation is maintained. The alloy can be a two-phase or multiphase alloy provided at least one phase is a solid solution as hereinbefore defined. The other phase or at least one of the other phases can consist of an intermetallic compound which is heat-recoverable as described in our co-pending U.S. Pat. application No. 88,596, filed Nov. 12, 1970.

We have found that the alloys used in this invention have high internal frictions or damping capacities when heat-treated in the manner described. This internal friction or damping capacity reaches its highest value at temperatures near to the $M_s$ and $M_f$ temperatures.

In alloys with an $M_s$ temperature above room temperature we have discovered that when they are quenched to a substantially lower temperature (−196° C, the boiling point of nitrogen is particularly convenient) in the martensitic condition and are then deformed at −196° C in the manner of the present invention, the restoration towards the original shape on heating above the $A_s$ temperature takes place in two stages. If the alloy is deformed in tension at −196° C, a contraction occurs slowly on heating from −196° C up to about 20° C so as to balance the thermal expansion normally expected. Thus the alloy behaves as if it has zero or near zero thermal expansion over this range of temperature.

We have also discovered that the extent of the shape change on heating an article made of alloys treated according to this invention can be reduced or even prevented by applying sufficient stress to oppose the shape change. The removal of this stress after heating to the upper temperature (i.e. above the $A_s$ temperature) allows a shape change to occur spontaneously instead of over a range of temperature as would have occurred in the absence of the opposing stress. The stress required to prevent the shape change whilst heating to a specific temperature is a measure of the force which can be developed by the alloy for doing external work.

This discovery can be used in several ways. One method is to suppress or partially suppress the shape change by an applied stress and then to use the force or energy released when the retraining force is removed suddenly to operate a device, for example, through a lever or by impact on a pin or by deforming or fracturing a suitable element of the device. Another method to use the force developed is to heat the part made from the heat recoverable material slowly through the $A_sA_f$ temperature range when it will exert a sustained and progressively increasing force on the operating element of the device as mentioned before. By control of the temperature, the rate and amount of increase of force or of movement can be controlled.

The following examples serve to further illustrate the invention and facilitate understanding of specific embodiments thereof.

In the following examples, the terms "retained strain" and "heat recoverable strain" have the following meanings.

1. RETAINED STRAIN a. The amount of permanent strain retained after a specimen has been deformed in tension. This will be expressed as a percentage strain based on a gauge length of 1 inch.

b. The angle retained when a straight specimen 0.31 inch thick bent through an angle of 180°, i.e., so the two arms of the specimen are parallel, and then allowed to relax elastically. A bend of 180° corresponds to a surface strain of about 4.25 percent.

2. HEAT RECOVERABLE STRAIN

This is expressed as:

a. As the actual percentage of the strain recovered on heating through the $A_s$ to $A_f$ temperature range in terms of the original gauge length of 1 inch.

b. It is the total angular movement from a specimen which has been originally bent to 180° and relaxed elastically and has then been heated.

Which type of strain is reported, i.e., whether as a percentage tensile strain or as an angle of bend will depend on the type of experiment which was performed and this in turn depends on the application of the material industrially.

EXAMPLE 1.

Manganese-Nickel Alloys

Particularly useful heat recoverable properties occur in manganese-nickel alloys containing 15–35 wt. percent nickel, preferably 20 – 28 percent nickel. As an example, a manganese alloy containing 22.5 percent nickel was rolled to sheet 0.02 inch thick, which was heated at 850° C for ¼ hour and quenched into water. After cooling to about −196° C it was deformed into a coil. On reheating to 200° C it straightened, though not quite to its original shape. On changing the temperature between 200° C and −196° C it coiled and uncoiled repeatedly.

EXAMPLE 2.

Cobalt-Manganese Alloys

Heat recoverable properties occur in cobalt-manganese alloys containing about 20 to 40 wt. percent manganese, preferably 25 to 35 percent manganese. In one example, an alloy containing 30 wt. percent manganese was heat treated for ½ hour at 1000° C and quenched into water. It was then subjected to bending deformation at −196° C and the following results were obtained

| | Heat Recoverable Strain | |
|---|---|---|
| Retained strain at −196° C | % Strain | Corresponding Angular Movement |
| 3.72% | 1.25% | 52° |

EXAMPLE 3

Titanium Base Alloys

Alloys containing elements which retain the B titanium phase were argon-arc melted and cast, then forged and rolled at 800° C in steel sheaths to prevent oxygen contamination to produce a sheet of thickness 0.04 inch.

Heat recoverable properties were found in titanium base alloys in which the B phase can be retained on cooling or quenching from a high temperature such that:

a. no omega phase is formed during heat treatment and the alloys can be cold worked at room temperature or at −196° C, or at appropriate temperatures in between and b. on cold working the B phase transforms to a stress induced martensite phase or alternatively the martensite is formed by simple cooling and then deformation.

The following are examples of heat-recoverable titanium-base alloys. The alloys were tested in the form of sheet which was bent through 90° which gave a 2 percent outer fibre strain at a low temperature and were then heated to above the As temperature. All alloys were water quenched from 850° C.

1. Titanium-Molybdenum alloys containing 8–16 wt. percent Molybdenum. The preferred range is 14–16 percent Molybdenum. A 14 percent Molybdenum alloy was bent through 90° at −196° C and when reheated to room temperature a heat recoverable strain of 20° was obtained.

2. Titanium-Manganese alloys containing 5–10 wt. percent Manganese, preferably 6–7 percent Manganese. A 6 percent Manganese alloy was bent through 90° at −196° C, and when reheated to ambient temperature there was a heat recoverable strain of 10°.

3. Titanium-Niobium alloys containing 30–42 percent Niobium, preferably 32–34 percent Niobium. A 34 percent Niobium alloy was bent through 90° at −196° C, and gave a heat recoverable strain of 50 percent. It was also bent through 90° at 20° C and gave a heat recoverable strain of 40°.

In these examples of titanium base alloys, the widest practical range of composition comprise alloys in which the lower limit of addition of one or more metallic elements to titanium is the composition at which B phase is retained at room temperature, and the upper limit is the composition at which the Ms temperature becomes significantly below −196° C provided only that stress induced martensite is formed on deformation. Heat recoverable strain occurs over a wide range of temperatures during reheating i.e. and As and Af temperatures are widely separated. In this the Titanium alloys resemble the Iron base alloys described in copending application Ser. No. 510,172, filed Sept. 30, 1974. It should, of course, be noted however that for special applications useful alloys can be obtained which have a transformation temperature substantially above room temperature.

We claim:

1. A method of making a heat-recoverable article which comprises cooling an article in a first shape from a first temperature to a lower temperature, said article being formed from an alloy comprising at least one phase in the form of a primary solid solution of a first metal with at least one other metallic element, which solution on cooling from said first temperature at least partially transforms into an essentially banded martensite, and then deforming the article into a second shape, the temperatures and rate of cooling being such that, on reheating, the article at least partly resumes said first shape, said alloy comprising titanium, manganese, cobalt or mixtures thereof alloyed with niobium, molybdenum, iron, nickel, chromium, vanadium or mixtures thereof.

2. The method of claim 1 wherein said cooling is effected by quenching.

3. The method of claim 1 wherein said alloy is a manganese-nickel alloy containing 15–35 wt. percent nickel.

4. The method of claim 1 wherein said alloy is a manganese-cobalt alloy containing 20–40 wt. percent manganese.

5. The method of claim 1 wherein said alloy is a titanium-molybdenum alloy containing 8–16 wt. percent molybdenum.

6. The method of claim 1 wherein said alloy is a titanium-manganese alloy containing 5–10 wt. percent manganese.

7. The method of claim 1 wherein said alloy is a titanium-niobium alloy containing 30–42 wt. percent niobium.

8. A method of making a heat-recoverable article which comprises cooling an article in a first shape from a first temperature to a lower temperature, said article being formed from an alloy comprising at least one phase in the form of a primary solid solution of a first metal with at least one other metallic element, which solution on cooling from said first temperature retains the high temperature phase but which transforms to an essentially banded martensite on cold working, and then deforming the article into a second shape by cold working, the temperatures and rate of cooling being such that, on reheating, the article at least partly resumes said first shape, said alloy comprising titanium, manganese, cobalt or mixtures thereof alloyed with niobium, molybdenum, iron, nickel, chromium, vanadium or mixtures thereof.

9. The method of claim 8 wherein said cooling is effected by quenching.

10. The method of claim 8 wherein said alloy is a manganese-nickel alloy containing 15–35 wt. percent nickel.

11. The method of claim 8 wherein said alloy is a manganese-cobalt alloy containing 20–40 wt. percent manganese.

12. The method of claim 8 wherein said alloy is a titanium-molybdenum alloy containing 8–16 wt. percent molybdenum.

13. The method of claim 8 wherein said alloy is a titanium-manganese alloy containing 5–10 wt. percent manganese.

14. The method of claim 8 wherein said alloy is a titanium-niobium alloy containing 30–42 wt. percent niobium.

* * * * *